United States Patent [19]

Palacio et al.

[11] Patent Number: 4,570,407

[45] **Date of Patent: * Feb. 18, 1986**

[54] TRUSS ASSEMBLY AND ATTACHMENT MEMBER FOR USE WITH TRUSSES

[75] Inventors: Joaquin J. Palacio; Carlos C. Cristobal, both of Miami, Fla.

[73] Assignee: Gang-Nail Systems, Inc., Miami, Fla.

[ * ] Notice: The portion of the term of this patent subsequent to Aug. 14, 2001 has been disclaimed.

[21] Appl. No.: 528,967

[22] Filed: Sep. 2, 1983

Related U.S. Application Data

[63] Continuation-in-part of Ser. No. 423,252, Sep. 24, 1982, Pat. No. 4,525,972, and a continuation-in-part of Ser. No. 456,359, Jan. 7, 1983, Pat. No. 4,464,885.

[51] Int. Cl.[4] ..... E04C 3/02

[52] U.S. Cl. ..... 52/693; 52/712; 52/DIG. 6; 411/464; 411/466

[58] Field of Search ..... 52/506, 693–696, 52/702, 712, DIG. 6, 634–636, 643, 646; 411/463–468

[56] References Cited

U.S. PATENT DOCUMENTS

| | | | |
|---|---|---|---|
| 2,358,277 | 9/1944 | Manofsky | 52/506 X |
| 3,234,841 | 2/1966 | Adams | 52/712 X |
| 3,503,173 | 3/1970 | Jureit | 52/693 X |
| 4,295,318 | 10/1981 | Perlman | 52/693 |
| 4,455,805 | 6/1984 | Rionda et al. | 52/712 |
| 4,464,885 | 8/1984 | Palacio et al. | 52/693 |

*Primary Examiner*—Carl D. Friedman
*Assistant Examiner*—Richard E. Chilcot, Jr.
*Attorney, Agent, or Firm*—LeBlanc, Nolan, Shur & Nies

[57] ABSTRACT

A truss assembly and attachment member for use in constructing truss assemblies. The attachment member includes an intermediate leg with first and second connecting plates disposed at opposite ends of the intermediate leg. Each of the connecting plates have a plurality of teeth extending generally perpendicular from the connecting plates. The intermediate leg has at least one groove extending from the same side as the sharp projections of the connecting plates and extending substantially the entire length of the leg between the connecting plates. This groove is deeper in the proximity of the connecting plates than in the center of the leg midway between the connecting plates. The leg also has a pair of side flanges projecting from both its outside edges and extending in the same direction as the groove. The depth of the side flanges varies along their length with the lowest depth being in the proximity of the connecting plates and the highest depth being in the proximity of the midpoint of the flanges located between the connecting plates.

32 Claims, 7 Drawing Figures

TRUSS ASSEMBLY AND ATTACHMENT MEMBER FOR USE WITH TRUSSES

CROSS REFERENCE TO RELATED APPLICATIONS

The present application is a continuation-in-part of U.S. patent applications Ser. No. 423,252, filed on Sept. 24, 1982 now U.S. Pat. No. 4,525,972, and entitled TRUSS ASSEMBLY AND BRACING CLIP AND attachment MEMBER FOR USE WITH TRUSSES and Ser. No. 456,359 filed Jan. 7, 1983 now U.S. Pat. No. 4,464,885, and entitled TRUSS ASSEMBLY AND ATTACHMENT MEMBER FOR USE WITH TRUSSES and a divisional of said application Ser. No. 423,252. These applications are assigned to the assignee of the present invention. These applications are hereby incorporated herein by reference.

BACKGROUND OF THE INVENTION

The present invention relates to wooden trusses used for supporting structural loads and to hardware used in constructing wooden trusses which enhances the ease of installation and increases the resultant structural ridigity of the installed trusses for bearing structural loads.

In constructing various types of wooden trauss assemblies, inlcuding both roof trusses and floor joists, it has been common to use large wooden structural members such as 2" by 10"s. Such large wooden members, however, are becoming increasingly difficult to obtain and have increased substantially in cost. Consequently various alternatives have been sought for enabling the construction of trusses which are able to bear the structural loads of full dimension lumber but which are constructed from smaller pieces of dimension lumber such as 2"×4" members which are spaced apart by metal connectors.

Substitutes for full dimension lumber roof trusses and floor joists must satisfy two primary criteria. First, the trusses must be able to withstand large compressive loads so that they may be used for bearing substantial structural loads. Secondly, it is desirable that the trausses be prefabricated at a manufacturing plant at a low labor cost and shipped to a building site without a high degree of risk of incurring damage to the trusses.

Various types of hardware have been developed for making prefabricated trusses. U.S. Pat. Nos. 3,025,577, to Jureit, 3,298,151 to Jureit, 3,503,173 to Jureit, 4,078,352 to Knowles and 4,348,850 to Reeder et al. and the U.S. patent application Ser. No. 337,671, field Sept. 24, 1982 and entitled TRUSS STRUCTURES CONSTRUCTED WITH METAL WEB MEMBERS, which is assigned to the assignee of the present invention, are representative of metal connectors which have been used for manufacturing trusses from smaller dimension lumber such as 2"×4" s. Said patent application Ser. No. 337,671 is hereby incorporated by reference.

The latter of the noted Jureit patents (U.S. Pat. No. 3,503,173) discloses a metal strut member formed from a sheet metal plate for interconnecting top and bottom wooden chords where the strut member can have side longitudinally extending flanges and locating tabs stamped out of the ends of the plate.

The Knowles patent discloses a truss web structure with legs having pairs of longitudinally extending flanges which project in the same direction as teeth stricken from connectors located at each end on the web and at its apex and a longitudinally extending rib which projects in a direction opposite the direction of projection of the teeth. The Reeder et al. patent also discloses a web member for constructing truss structures with each leg of the web member having a pair of longitudinally extending flanges and locating tabs arranged at the ends of such flanges for arranging the web member on the wooden chord members.

The aforementioned U.S. patent application Ser. No. 337,671 discloses a metal web member with two legs and connecting plates disposed at the apex of the web member where the legs intersect and at the opposite end of each leg. The connecting plates each have a plurality of sharp projections extending generally perpendicular from the connecting plates. All of the connecting plates are disposed in the same plane. Each of the legs has at least one groove extending from the same side as the sharp projections of the connecting plates and extending substantially the entire length of the leg between the connecting plates. This groove is deeper in the proximity of the connecting plates than at the center of the leg midway between the connecting plates. On each of the legs, there is a pair of side flanges attached to and projecting from both outside edges of the leg and extending in the same direction as the groove in such leg. The depth of the side flanges varies throughout their length with the smallest depth being in the proximity of the connecting plates and the greatest depth being in the proximity of the midpoint of the flanges located between the connecting plates.

Attachment members have been marketed for connecting together the spaced apart wooden members which are used for constructing trusses. These attachment members have first and second connecting plates disposed at opposite ends of an intermediate leg which extends transversely between the ends of the spaced apart first and second wooden members of the truss. The intermediate leg of the aforementioned attachment members contains a plurality of parallel adjacent ridges of substantially constant cross-sectional shape and size which project outward away from the direction that the sharp projections in the connecting plates project when ingaging the spaced apart first and second wooden members of the truss.

SUMMARY OF THE INVENTION

An object of the present invention is to provide an improved attachment which may be secured so as to extend in a direction transverse to the longitudinal axis of the spaced apart upper and lower wooden members of a truss assembly to provide increased rigidity and resistance to torsional and compression forces imposed on the truss assembly.

A further object of the present invention is to provide an attachment member which is reinforced to resist bending movements resulting from the application of high loads.

An attachment member in accordance with the present invention provides a mechanism for connecting together the wooden chord members within individual trusses to provide increased rigidity and resistance to compression and torsional loading which could cause bending of the attachment members and collapsing of the truss assembly or could cause the upper and lower wooden chord members within the truss to twist with respect to each other.

An attachment member in accordance with the present invention, which is adapted for connecting two pieces of spaced apart wood together, is formed from a metal plate and includes first and second connecting members lying in the same general plane and disposed at opposite ends of an intermediate leg section. Each of the connecting members has a plurality of teeth stricken from the member and extending generally perpendicular from the metal plate. The intermediate leg has at least one longitudinally extending groove that projects from the same side of the plate as the teeth projecting from the connecting members and extending substantially the entire length of the intermediate leg between the connecting members. The depth of this groove varies along the length of the leg with the greatest depth being in the proximity of the connecting members and smallest depth, possibly even decreasing to zero, at its center located midway between the connecting members. A pair of side flanges are attached to and project from the outside edges of the intermediate leg; these flanges extend in the same direction as the groove.

In the preferred embodiment of the present invention the teeth are stricken from the connector members in pairs so as to leave a longitudinally extending slot betwen the teeth of each pair. These teeth and the slots are oriented such that the teeth lie approximately perpendicular to the longitudinal axis of the leg section and the slots lie substantially parallel to such axis of the leg section. At each of the ends of the leg section, adjacent to the connecting member, there is a locating tab which is stricken out of the leg section of the plate and leaves a longitudinally extending slot. The locating tabs are preferably arranged along the central axis of the leg. Located on opposite sides of the slot left in the plate by the locating tabs are longitudinally extending beads that project in a direction from the plate opposite to the direction of the teeth.

In the preferred embodiment of the present invention, the maximum depth of each of the flanges is approximately ½ of the width of the intermediate leg. The depth of the side flanges also can vary along the length of the flanges with the lowest depth being in the proximity of the connecting members and the highest depth being in the proximity of the mid-point of the flanges located between the connecting members.

A truss assembly in accordance with the invention includes a pair of spaced apart wooden members which are fixedly attached to a plurality of metal web members which are disposed along the length of the wooden members. Each of the wooden members has a first and a second end with the first end of the spaced apart first and second wooden members being the first end of the truss and the second end of the spaced apart first and second wooden members being the second end of the truss. The first end and the second end of the truss each having at least one attachment member attached between the first and second wooden members. The attachment member is formed from a metal plate and includes first and second connecting members lying in the same general plane and disposed at opposite ends of an intermediate leg section. Each of the connecting members has a plurality of teeth stricken from the plate and extending generally perpendicular to the connecting members. The intermediate leg has at least one groove extending from the same side of the metal plate as the teeth projecting from the connection members and extending substantially the entire length of the intermediate leg between the connecting member. The depth of this groove varies along the length of the leg with the depth being greater in the proximity of the connecting members than in the center of the intermediate leg between the connecting members. A pair of side flanges are attached to and project from the outside edges of the intermediate leg; these flanges extend in the same direction as the groove. The depth of the side flanges also can be varied throughout their length with the lowest depth being in the proximity of the connecting members and the highest depth being in the proximity of the midpoint of the flanges located between the connecting members.

DESCRIPTION OF THE PRFERRED EMBODIMENTS

Figure 1:
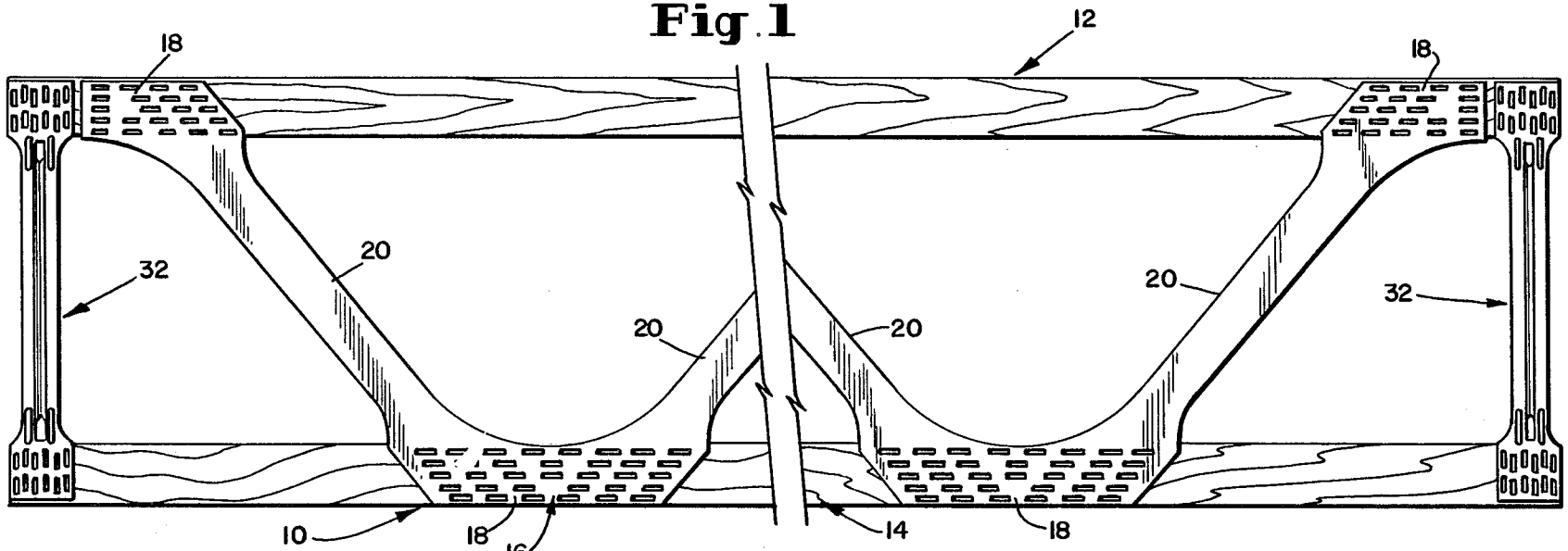
FIG. 1 is a side elevational view of a portion of a truss assembly constructed in accordance with the present invention with the use of an attachment member according to the present invention.

A truss 10 constructed in accordance with the present invention is shown in FIG. 1. The truss 10 is constructed for use as a floor joist and is manaufactured from an upper wooden member 12 and a lower wooden member 14 which may be made from standard dimension lumber such as a 2″×4″ which is turned on its side so that the width of each 2″×4″ within a truss is parallel to the horizontal.

The upper wooden member 12 and the lower wooden member 14 are fixedly attached to a plurality of metal web members 16 which may be of any known construction but which preferably are those which are described in the aforementioned U.S. patent application Ser. No. 337,671. Each of the metal web members 16 has three connecting plate members 18 which have a plurality of sharp teeth-like projections with are pressed into the wooden members 12 and 14 so that they are completely embedded in the wood to securely attach the metal web member to the upper and lower wooden members. The sharp teeth-like projections preferably are manufactured in accordance with the teachings of U.S. Pat. No. 4,343,580 which is assigned to the assignee of the present invention. A pair of legs 20 of each web member 16 connect the connecting plate member 18 at the vertex with the connecting plate members at the ends of the web member.

Both of the ends of the upper wooden member 12 and the lower wooden member 14 are braced with attachment members 32 which are attached adjacent to the ends of the wooden members 12 and 14. The atachment member is described below in conjunction with FIGS.

Figure 4:
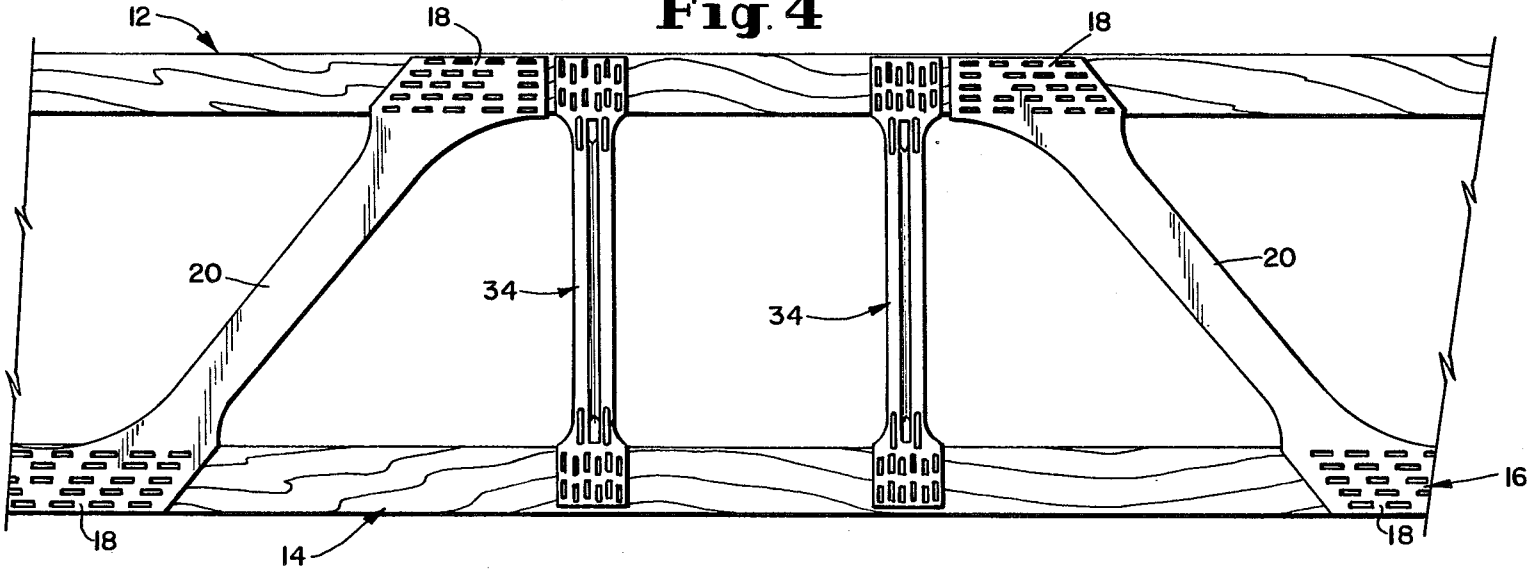
FIG. 4 is a side elevational view of a portion of another truss assembly constructed in accordance with the present invention with the use of an attachment member according to the present invention.

2, 3(a), 3(b) and 3(c). Attachment members also can be arranged at intermediate locations along wooden members 12 and 14. Such intermediate attachment members, such as attachment members 34, can be used if additional support is needed in longer truss structures or to box in an area in the truss structure through which a duct is to pass such as shown in FIG. 4.

The attachment member 32 of the present invention is illustrated in FIGS. 2 and FIGS. 3(a), 3(b) and 3(c). The attachment member 32 has a pair of spaced apart connecting plate members 96 which are separated by an intermediate leg section 98. Each connecting plate member has a plurality of sharp teeth projections 100 which are stricken from the section of the sheet metal plate forming the connector plate member and leave slots 101 in the metal plate. These teeth 100 extend generally perpendicularly from the plane of the connecting plate member 96 and are oriented such that the major portion of the face of each tooth faces the longitudinal axis of the attachment member. The construction of the teeth projections 100 are preferably made in accordance with the teachings of U.S. Pat. No. 4,343,580.

In the sheet metal plate forming the attachment member in each of the areas adjacent to the connecting plate members 96, there is a locating tab 106 that is struck out of the plate leaving a slot 108. Locating tab 106 extends in the same direction as teeth projections 100 but the locating tab is longer and generally wider than the teeth projections. This locating tab is used to assist in positioning the wooden chords 12 and 14 with the attachment member arranged between the chords. When constructing truss structure 10, the attachment is placed so that the locating tabs abut the inner edges of wooden chords 12 and 14 and the connecting plate members lie over the side faces of the wooden chords. The teeth 100 of the connecting plate members subsequently are driven into the wooden chords.

On opposite sides of each of slots 108 formed by striking out locating tabs 106 are beads 110 and 112. These beads 110 and 112 act to shift the moment of inertia in the area of the locating tab in the attachment member. The cross-sectional shape of beads 110 and 112 are shown in FIG. 3(a), which is taken along line *3a—3a* in FIG. 2. These beads extend slightly beyond slot 108 as shown in FIG. 2.

Figure 3B:
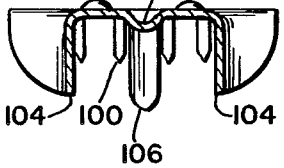
FIG. 3(b) is a cross-sectional view of the attachment member shown in FIG. 2 taken along line 3*b*—3*b*.
Figure 3C:
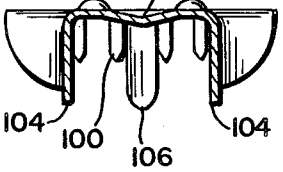
FIG. 3(c) is a cross-sectional view of the attachment member shown in FIG. 2 taken along line 3*c*—3*c*.
Figure 3A:
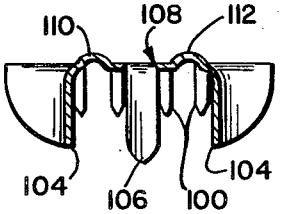
FIG. 3(a) is a cross-sectional view of the attachment member shown in FIG. 2 taken along section lines 3*a*—3*a*.

The intermediate section 98 has a cross-sectional shape which is illustrated in detail in FIGS. 3(a), 3(b) and 3(c). A groove 102 exends substantially the entire length of the intermediate section 98. The groove 102 projects in the same direction as the teeth projections 100 of the connecting plate members 96. A pair of side flanges 104 are loacted at the outside edges of the intermediate leg section 98; these flanges also project in the same direction as the teeth projections 100.

Figure 2:
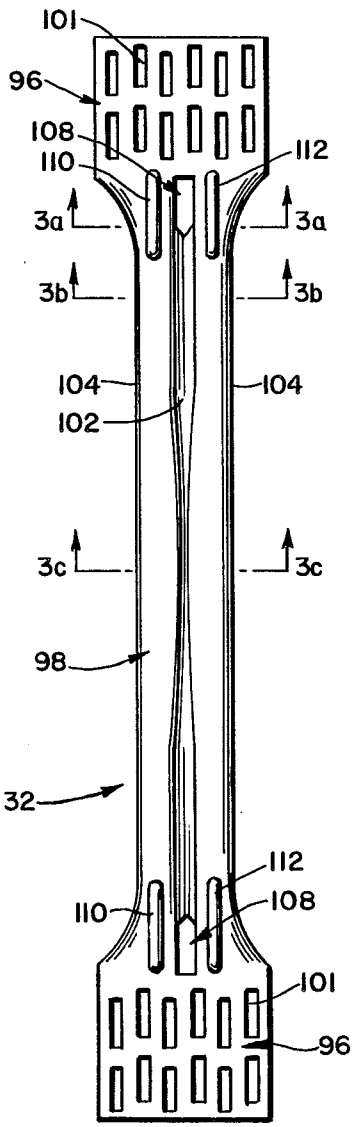
FIG. 2 is a top plan view of an attachment member in accordance with the present invention.

FIGS. 3(b) and 3(c), which are respectively cross-sectional views taken along section lines *3b—3b* and *3c—3c* of FIG. 2, illustrate the variation in the depth of the groove 102. In addition, the height of the side flanges 104 can be varied along their length as shown in FIGS. 3(b) and 3(c). Specifically, the depth of the groove 102, which extends from the same side of attachment member 32 as teeth projections 100, is greatest in the proximity of the point of attachment of the intermediate leg section 98 to the respective connecting plate members 96. The depth of the groove 102 is smallest in the proximity of the midpoit of the intermediate section 98 located between the connecting plate members 96. The depth of the groove 102 varies gradually along the length of the intermediate leg section 98 between the deepest and shallowest points. The preferred variation in depth of groove 102 is a substantially uniform variation along the length of the intermediate section.

The side flanges 104 project in the same direction from the attachment member as the groove 102 and the teeth projections 100. The smallest depth of the side flanges 104 is reached in the proximity of the point of attachment of the ends of the intermediate section 98 to the connecting plate members 96. The variation in height of the flanges 104 is gradual between the ends in the proximity of connecting plate members 96 and the midpoint of the intermediate leg section 98. The greatest depth of the side flanges 104 is reached in the proximity of the midpoint of the intermediate leg section 98 located between the connecting plate members 96. The metal not used in forming the groove as the depth of the groove decreases can be taken up by increasing the depth of the flanges. The width of the intermediate leg section 98 is substantially uniform along its length. Thus, the attachment member can be formed starting with a rectangular metal blank.

The groove 102 and the side flanges 104 function as a means for stiffening the attachment member to sufficiently increase the ridigity of the member for avoiding bending under compressive or tortional loads. In the preferred form of the invention, the maximum depth of each of the flanges 104 is approximately $\frac{1}{2}$ and at least approximately $\frac{1}{3}$ of the width of the intermediate leg section 98.

Figure 5:
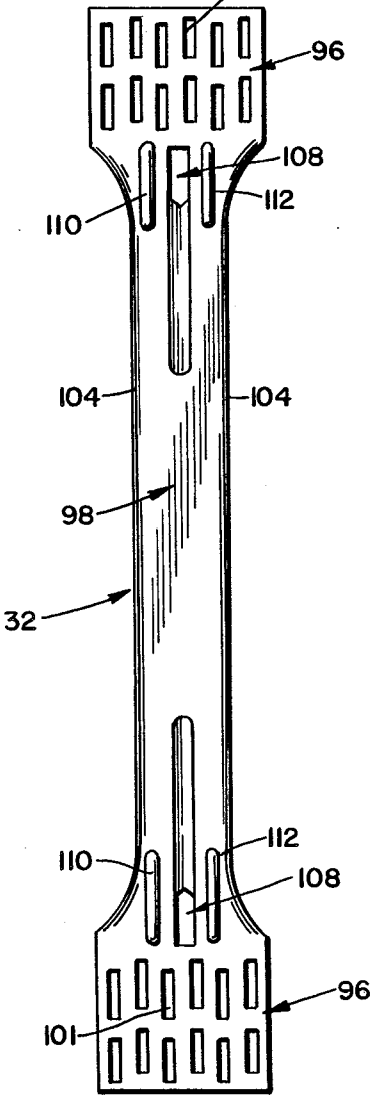
FIG. 5 is a top plan view of another embodiment of an attachment member in accordnace with the present invention.

As an alternative to a single groove 102 extending the entire length of the intermediate section, two smaller grooves which project in the same direction as groove 102 can be used with one such groove being located at each end of the intermediate section 98. An attachment member with the two smaller grooves is shown in FIG. 5. When two small grooves are used, the extra metal that is not taken up in forming the grooves in proximity to the midpoint can be used for forming deeper side flange 104 in the central portion of the intermediate section 98.

While the preferred use of the attachment member is to connect the upper and lower wooden members 12 and 14 within a truss 10, it should be clearly understood that the invention may be used to connect together spaced apart pieces of wood for any use.

The invention may be embodied in other specific forms without departing from the spirit or essential characterisics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An attachment member adapted for connection of two spaced apart wooden members comprising:

(a) first and second connection plates disposed at opposite ends of an intermediate leg section, said connecting plates each having two sides and a plurality of teeth projecting generally perpendicular to said connecting plates from one side of said connecting plates, said connecting plates being disposed in the same plane; and (b) said intermediate leg section interconnecting said connecting plates and having a groove extending from the same side of said attachment member as said teeth projecting from said connecting plates and extending substantially the entire length of said intermediate leg section between said connecting plates, the depth of said groove varying along its length with such depth being greatest in the proximity of said connecting plates and smallest in the center of said intermediate leg section between said connecting plates and said intermediate leg section having a pair of side flanges attached to and projecting from said intermediate leg section on the outside edges of said intermediate leg section and extending in the same direction from said attachment member as said groove.

2. An attachment member according to claim 1 wherein the depth of said groove varies substantially continuously along the length of said groove.

3. An attachment member according to claim 1 wherein the depth of said side flanges varies along their length with the smallest depth of said side flanges being in the proximity of said connecting plates and the greatest depth being in the proximity of the midpoint of said flanges located between said connecting plates.

4. An attachment member according to claim 3 wherein the projection of each of said flanges at its deepest point is at least approximately $\frac{1}{3}$ of the width of said intermediate leg section.

5. An attachment member according to claim 3 wherein the projection of each of said flanges at its deepest point is approximately $\frac{1}{2}$ of the width of said intermediate leg section.

6. An attachment member according to claim 1 wherein said intermediate leg section has a locating tab at each end adjacent to each of said connecting plates, said locating tabs extend from said intermediate leg section in the same direction as said side flanges and serves to assist in arranging said attachment member between wooden members to be interconnected by said attachment member with said connecting plates lying over such wooden members, and said locating tabs being struck out of said intermediate leg section so as to leave longitudinally extending slots in said intermediate leg section.

7. An attachment member according to claim 6 wherein said intermediate leg section has beads extending in a longitudinal direction and projecting in a direction opposite said location tabs, one of said beads being located and extending along each side of each of said slots formed by said locating tabs.

8. An attachment member according to claim 7 wherein each of said teeth has its face lying approximately perpendicular to the longitudinal axis of said attachment member.

9. An attachment member according to claim 1 wherein each of said teeth has its face lying approximately perpendicular to the longitudinal axis of said attachment member.

10. An attachment member adapted for connection of two spaced apart wooden members comprising:

(a) first and second connecting plates disposed at opposite ends of an intermediate leg section, said connecting plates each having two sides and a plurality of teeth projecting generally perpendicularly to said connecting plates from one side of said connecting plates, said connecting plates being disposed in the same plane; and (b) said intermediate leg section interconnecting said connecting plates and having two grooves extending from the same side of said attachment member as said teeth project from said connecting plates and extending along the length of the said intermediate leg section between said connecting plates, said grooves being located at opposite ends of said intermeidate leg section and said intermeidate leg section having a pair of side flanges attached to and projecting from said intermediate leg section on the outside edges of said intermediate leg section and extending in the same direction from said attachment member as said grooves.

11. An attachment member according to claim 10 wherein the depth of said side flanges varies along their length with the smallest depth of said side flanges being in the proximity of said connecting plates and the greatest depth being in the proximity of the midpoint of said flanges located between said connecting plates.

12. An attachment member according to claim 11 wherein the projection of each of said flanges at its deepest point is at least approximately $\frac{1}{3}$ of the width of said intermediate leg section.

13. An attachment member according to claim 11 wherein the projection of each of said flanges at its deepest point is approximately $\frac{1}{2}$ of the width of said intermediate leg section.

14. An attachment member according to claim 10 wherein said intermediate leg section has a locating tab at each end adjacent to each of said connecting plates, said locating tabs extend from said intermediate leg section in the same direction as said side flanges and serves to assist in arranging said attachment member between wooden members to be interconnected by said attachment member with said connecting plates lying over such wooden members, and said locating tabs being struck out of said intermediate leg section so as to leave longitudinally extending slots in said intermediate leg section.

15. An attachment member according to claim 14 wherein said intermediate leg section has beads extending in a longitudinal direction and projecting in a direction opposite said locating tabs, one of said beads being located and extending along each side of each of said slots formed by said locating tabs.

16. An attachment member according to claim 15 wherein each of said teeth has its face lying approximately perpendicular to the longitudinal axis of said attachment member.

17. A wooden truss comprising:

(a) A pair of spaced apart wooden members fixedly attached to a plurality of metal web members which are disposed along the length of the wooden members, the wooden members each having a first end and a second end, the first end of the spaced apart said first and second wooden members being the first end of the truss and the second end of the spaced apart first and second wooden members being the second end of the truss, the first end and the second end of the truss having at least one attachment member attached thereto between the first and second wooden members, said attachment member including:

(b) first and second connecting plates disposed at opposite ends of an intermediate leg section, said connecting plates each having two sides and a plurality of teeth projecting generally perpendicular to said connecting plates from one side of said connecting plates, said connecting plates being disposed in the same plane; and (c) said intermediate leg section interconnecting said connecting plates and having a groove extending from the same side of said attachment member as said teeth projecting from said connecting plates and extending substantially the entire length of said intermediate leg section between said connecting plates, the depth of said groove varying along its length with such depth being greatest in the proximity of said connecting plates and smallest in the center of said intermediate leg section between said connecting plates and said intermediate leg section having a pair of side flanges attached to and projecting from said intermediate leg section on the outside edges of said intermediate leg section and extending in the same direction from said attachment member as said groove.

18. A wooden truss according to claim 17 wherein the depth of said groove varies substantially continuously along the length of said groove.

19. A wooden truss according to claim 17 wherein the depth of said side flanges varies along their length with the smallest depth of said side flanges being in the proximity of said connectin plates and the greatest depth being in the proximity of the midpoint of said flanges located between said connecting plates.

20. A wooden truss according to claim 19 wherein the projection of each of said flanges at its deepest point is at least approximately $\frac{1}{3}$ of the width of said intermediate leg section.

21. A wooden truss according to claim 19 wherein the projection of each of said flanges at its deepest point is approximately $\frac{1}{2}$ of the width of said intermediate leg section.

22. A wooden truss according to claim 17 wherein said intermediate leg section has a locating tab at each end adjacent to each of said connecting plates, said locating tabs extend from said intermediate leg section in the same direction as said side flanges and serves to assist in arranging said attachment member between wooden members to be interconnected by said attachment member with said connecting plates lying over such wooden members, and said locating tabs being struck out of said intermediate leg section so as to leave longitudinally extending slots in said intermediate leg section.

23. A wooden truss according to claim 22 wherein said intermediate leg section has beads extending in a longitudinal direction and projecting in a direction opposite said locating tabs, one of said beads being located and extending along each side of each of said slots formed by said locating tabs.

24. A wooden truss according to claim 23 wherein each of said teeth has its face lying approximately perpendicular to the longitudinal axis of said attachment member.

25. A wooden truss according to claim 17 wherein each of said teeth has its face lying approximately perpendicular to the longitudinal axis of said attachment member.

26. A wooden truss comprising:

(a) A pair of spaced apart wooden members fixedly attached to a plurality of metal web members which are disposed along the length of the wooden members, the wooden members each having a first end and a second end, the first end of the spaced apart said first and second wooden members being the first end of the truss and the second end of the spaced apart first and second wooden members being the second end of the truss, the first end and the second end of the truss having at least one attachment member attached thereto between the first and second wooden members, said attachment member including:

(b) first and second connecting plates disposed at opposite ends of an intermediate leg section, said connecting plates each having two sides and a plurality of teeth projecting generally perpendicular to said connecting plates from one side of said connecting plates, said connecting plates being disposed in the same plane; and (c) said intermediate leg section interconnecting said connecting plates and having two grooves extending from the same side of said attachment member as said teeth projecting from said connecting plates and extending along the length of said intermediate leg section between said connecting plates, said grooves being located at opposite ends of said intermediate leg section and said intermediate leg section having a pair of side flanges attached to and projecting from said intermediate leg section on the outside edges of said intermediate leg section and extending in the same direction from said attachment member as said grooves.

27. A wooden truss according to claim 26 wherein the depth of said side flanges varies along their length with the smallest depth of said side flanges being in the proximity of said connecting plates and the greatest depth being in the proximity of the midpoint of said flanges located between said connecting plates.

28. A wooden truss according to claim 27 wherein the projection of each of said flanges at its deepest point is at least approximately $\frac{1}{3}$ of the width of said intermediate leg section.

29. A wooden truss according to claim 27 wherein the projection of each of said flanges at its deepest point is approximately $\frac{1}{2}$ of the width of said intermediate leg section.

30. A wooden truss according to claim 26 wherein said intermediate leg section has a locating tab at each end adjacent to each of said connecting plates, said locating tabs extend from said intermediate leg section in the same direction as said side flanges and serves to assist in arranging said attachment member between wooden members to be interconnected by said attachment member with said connecting plates lying over such wooden members, and said locating tabs being struck out of said intermediate leg section so as to leave longitudinally extending slots in said intermediate leg section.

31. A wooden truss according to claim 30 wherein said intermediate leg section has beads extending in a longitudinal direction and projecting in a direction opposite said locating tabs, one of said beads being located and extending along each side of each of said slots formed by said locating tabs.

32. A wooden truss according to claim 31 wherein each of said teeth has its face lying approximately perpendicular to the longitudinal axis of said attachment member.

* * * * *